US005253899A

United States Patent [19]

Greenwood

[11] Patent Number: 5,253,899

[45] Date of Patent: Oct. 19, 1993

[54] SPECIALTY GAME CARDS AND METHOD FOR MAKING SAME

[75] Inventor: W. Loren Greenwood, Woodinville, Wash.

[73] Assignee: Ace Novelty Co., Inc., Bellevue, Wash.

[21] Appl. No.: 477,675

[22] Filed: Feb. 9, 1990

[51] Int. Cl.[5] ..... B42D 15/00

[52] U.S. Cl. ..... 283/106; 283/903; 283/111

[58] Field of Search ..... 283/106, 903, 111; 428/40, 124, 126, 194; 273/155

[56] References Cited

U.S. PATENT DOCUMENTS

| | | | |
|---|---|---|---|
| 426,849 | 4/1890 | O'Beirne et al. . | |
| 3,512,780 | 5/1970 | Allison | 273/139 |
| 3,900,219 | 8/1975 | D'Amato et al. | 283/903 |
| 4,033,611 | 7/1977 | Johnsen | 283/6 |
| 4,074,911 | 2/1978 | Stipek, Jr. | 283/106 |
| 4,099,721 | 7/1978 | Logander | 273/139 |
| 4,128,954 | 12/1978 | White | 283/106 |
| 4,174,857 | 11/1979 | Koza | 283/6 |
| 4,428,526 | 1/1984 | Riley | 283/106 |
| 4,551,373 | 11/1985 | Conlon | 428/43 |
| 4,603,884 | 8/1986 | Burton | 283/1 A |
| 4,616,815 | 10/1986 | Vijuk | 270/45 |
| 4,703,933 | 11/1987 | Cahill et al. | 273/139 |
| 4,726,608 | 2/1988 | Walton | 283/903 |
| 4,726,972 | 2/1988 | Instance | 428/124 |
| 4,768,810 | 9/1988 | Mertens | 428/126 |
| 4,778,153 | 10/1988 | Bachman et al. | 283/101 |
| 4,812,195 | 3/1989 | Vijuk | 156/357 |

FOREIGN PATENT DOCUMENTS

| | | | |
|---|---|---|---|
| 1540639 | 2/1979 | United Kingdom | 283/106 |
| 2085308 | 4/1982 | United Kingdom . | |
| 2183203 | 6/1987 | United Kingdom | 283/106 |

OTHER PUBLICATIONS

Bingo Ticket; Irish Ticket.

*Primary Examiner*—Paul A. Bell

*Attorney, Agent, or Firm*—Jones, Day Reavis & Pogue

[57] ABSTRACT

An improved specialty ticket of the paper type having a first panel with visible indicia on a portion thereof to identify the ticket and a second panel formed with folded sections concealing indicia that represents winning or non-winning combinations thereon. The perforations extend along and through the side edges of at least the folded sections to hold the folded sections securely together while allowing the folded sections to be easily separated for viewing the combination of indicia on the second panel. Opaque colors such as dark black or dark blue are placed on at least one side of at least one of the foldable sections to prevent viewing of the concealed indicia when the sections are folded.

14 Claims, 2 Drawing Sheets

SPECIALTY GAME CARDS AND METHOD FOR MAKING SAME

FIELD OF THE INVENTION

The present invention relates to specialty tickets of the paper type and in particular to a specialty ticket having a first panel with visible indicia on a portion thereof identifying the ticket and a second panel formed with folded surfaces concealing indicia that represents winning or non-winning combinations and the use of perforations extending along and through the side edges of the folded surfaces to hold the folded surfaces together thus allowing them to be easily separated for viewing the combination of indicia on the second panel. Further, an opaque color is placed upon at least one side of one or more panels, instead of a paper band, to prevent the concealed indicia from becoming visible to the naked eye upon "candling" with high powered light sources.

BACKGROUND OF THE INVENTION

Games of chance are becoming increasingly a part of industry and commerce. Such games of chance include specialty tickets of the paper type which have first and second sections, a first section of which identifies the ticket and a second section which contains a hidden combination of indicia representing winning and non-winning combinations. In one such type of ticket, the portion containing the concealed indicia comprises a plurality of folded panels on the inside of which is printed the combination of indicia. Once the panels are folded, a strip of thin colored paper is wrapped over the outside of the folded panels and the ends of the paper are glued together to hold the panels in the folded condition. The colored paper also serves to prevent the concealed indicia from becoming visible upon "candling" with a high power light source. When the purchaser desires to open the ticket he simply tears the thin paper wrapping and opens the folds.

In another type of specialty ticket, one or more combinations of indicia may be placed on a first card with a second card placed over and covering the surface of the first card. The two cards are attached in some manner such as by glue placed around the edges. Over each combination of indicia is a rectangular cover section in the second card that has perforated edges around at least three sides thereof which can be torn loose and the rectangular cover section lifted to view the indicia thereunder.

Because these specialty tickets are becoming so numerous, it is important that they be made as economical as possible and as simply as possible and still ensure that the concealed indicia cannot be seen through the paper without the ticket being opened. In the prior art specialty tickets, it is expensive and time consuming to either place a colored paper band around the folded portion of the ticket and glue the ends thereof or to place a top card over the indicia printed on a bottom card and place perforations in the top card to form an area superimposed on and surrounding the indicia on the bottom card so that the perforated area of the top card can be torn loose to expose the concealed indicia.

The present invention overcomes these disadvantages of the prior art by providing a specialty ticket that has a first panel with identifying indicia and a second panel formed with folded sections that conceal winning or non-winning combinations of indicia. The sections are securely held by perforations extending along and through the side edges of only the folded sections forming the second panel. These perforations hold the folded sections securely together yet allow them to be easily separated so that the combination of indicia concealed on the inside of these sections may be exposed. The folded sections also have an opaque color on at least one side of one or more of them to prevent the concealed indicia from being viewed through the folded sections.

In addition, if desired, or if required by legal conditions established by any particular governmental entity, a glue dot may be placed between the first panel and at least the folded section of the second panel abutting the first panel to assist in preventing unintended separation of the folded sections.

Further, if desired, an adhesive type of glue may be used on the edges of the folded sections which allow them to be stuck together but which does not form a permanent bond and which will allow the foldable sections to be pulled apart and cause the panels to be rather similar to "self removal notes".

Further, if desired, one or more glue dots may be placed along the side edges of the folded sections to hold them securely in place.

A method is disclosed in which the elongated tickets in the unfolded state are first imprinted by well known means with the desired indicia. At the printing station, the opaque colors are added to prevent the concealed indicia from being revealed with a powerful light when then the ticket is in its folded state. The printed ticket is then conveyed to a device well-known in the art for placing a glue spot in the proper location or locations thereon as well as imprinting fold or score lines in the proper locations upon the ticket. The ticket is then transported to the next station where a machine well known in the art folds the ticket in proper sequence about the fold or score lines with the folded portions extending over the glue spot or spots. Finally, if desired, the folded ticket is perforated along the side edges of the folded portion by a perforating machine well known in the art to provide a crimping of the edges and cause them to adhere tightly together.

SUMMARY OF THE INVENTION

The present invention is an improvement in specialty tickets of the paper type having a first panel with visible indicia on one portion thereof to identify the ticket and a CA second panel formed with folded sections concealing indicia that represents winning or non-winning combinations, the improvement comprising perforations extending along and through the side edges of at least the folded sections to hold the folded sections securely together while allowing the folded sections to be easily separated for viewing the concealed indicia on the second panel.

The invention also relates to an improved method of forming a specialty ticket of the paper type having a first panel with visible indicia on one portion thereof to identify the ticket CA and a second panel formed with folded sections concealing indicia that represents winning or non-winning combinations, the improvement comprising the steps of extending perforations along and through the side edges of at least the folded sections to hold said folded sections securely together while allowing the folded sections to be easily separated for viewing the concealed indicia on the second panel.

The invention also includes apparatus for forming a specialty ticket of the paper type having ticket identifying indicia imprinted on a first panel of the ticket and winning and non-winning combinations of indicia printed on a second panel of the ticket, the apparatus comprising first means for separating the first panel of the ticket from the second panel with a first fold line and separating the second panel of the ticket into first and second sections with a second fold line,, second means folding the first and second sections over each other about the second fold line to form a third second; third means folding the third section over at least a portion of the first panel to form a three thickness portion and fourth means for extending perforations along and through the side edges of at least the three thickness portion to hold the three thicknesses together while allowing the three thicknesses to be easily separated for viewing the concealed combination of indicia.

BRIEF DESCRIPTION OF THE DRAWINGS

These and other objects of the present invention will be more easily and readily understood by one skilled in the art by reference to the following detailed description taken in conjunction with the accompanying drawings in which like numerals represent like elements and in which.

DETAILED DESCRIPTION OF THE DRAWINGS

Figure 1A:
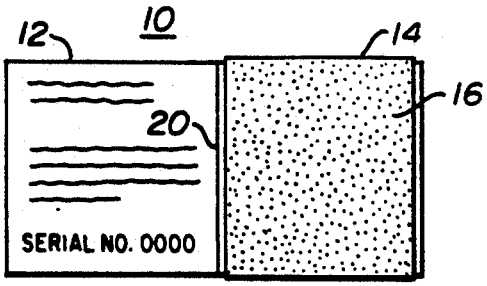
FIG. 1A PRIOR ART
FIG. 1A is a top view of a prior art specialty ticket.
Figure 1B:
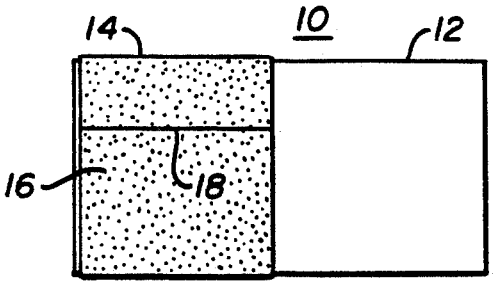
FIG. 1B PRIOR ART
FIG. 1B is a bottom view of the prior art specialty ticket of FIG. 1A.

FIG. 1A is a top view of a prior art specialty ticket in its folded condition. The ticket 10 has a first panel 12 having visible indicia thereon to identify the ticket and a section 14 comprising a plurality of folded panels having the indicia representing a winning or non-winning combination concealed thereunder and held in their folded condition by a colored paper covering 16 which is wrapped around the folded panels and glued to itself and to the folded panels 14. The colored paper serves to prevent viewing the concealed indicia with a high powered light. FIG. 1B is a bottom view of the prior art ticket of FIG. 1 illustrating an end edge 18 of the paper covering 16 that overlaps and is glued to the other end edge to keep the folded portion of the ticket intact. An edge 20 of the folded panels is shown protruding from under the paper covering 16 in FIG. 1A.

Figure 1C:
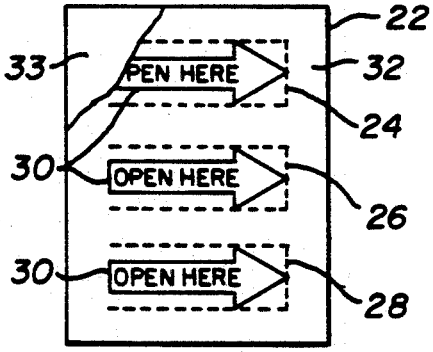
FIG. 1C PRIOR ART
FIG. 1C is a top view of a second embodiment of a prior art specialty ticket having a plurality of hidden indicia thereon.
Figure 1D:
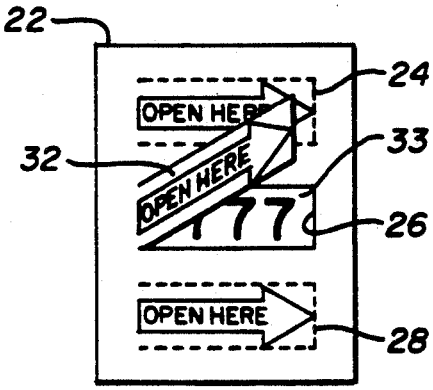
FIG. 1D PRIOR ART
FIG. 1D is a top view of the prior art specialty ticket illustrated in 1C showing one of the top covers partially removed so that the indicia thereunder can be seen.

FIG. 1C is a top view of an alternate embodiment of a prior art specialty ticket which contains a plurality of concealed indicia representing winning and non-winning combinations. In FIG. 1C, the ticket 22 has three perforated areas 24, 26 and 28 thereon under each of which is printed the concealed indicia representing the winning or non-winning combinations. When one purchases the ticket 22 in FIG. 1C, they simply use a finger nail or some sharp object to open the perforated sections 24, 26 or 28 as indicated by the arrows 30. FIG. 1D illustrates the ticket 22 of FIG. 1C with the top cover 32 torn loose from perforations 26 to expose the hidden indicia thereunder.

In each of the prior art specialty tickets illustrated in FIGS. 1A, 1B, 1C and 1D, complicated steps in the process require additional costs and difficulties in forming the tickets. For instance in regard to the ticket 10 in FIG. 1A and FIG. 1B, after the ticket has been imprinted with the desired indicia and the ticket folded, it must then be held in that position while colored paper cover 16 is wound around the folded portion with the ends of the paper cover overlapped and glued to each other and to the folded panels to hold the folded panels intact. In FIG. 1C and 1D, a bottom panel 33 must first be imprinted with the desired indicia thereon. The top panel must then be imprinted with the desired indicia and the perforations formed in the desired areas. The top panel is then glued to the bottom panel in proper alignment.

Figure 2A:
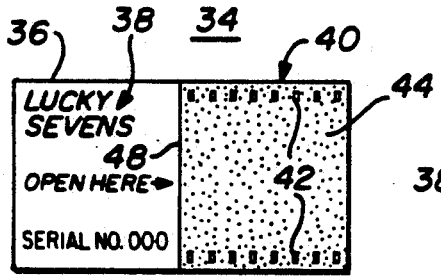
FIG. 2A is a top view of the novel specialty ticket of the present invention in its final folded state illustrating the perforations along the side edges of at least the folded portion to hold the ticket together.

The novel specialty ticket illustrated in FIG. 2A is constructed in such a way as to overcome the disadvantages of the prior art and enable it to be made in an efficient and economical manner. The ticket 34 in FIG. 2A comprises a first panel 36 with visible ticket identifying indicia 38 thereon to identify the ticket a non-indicia bearing second portion or area 56. The second panel 40 is formed with folded sections as will be shown in FIGS. 2B and 2C to conceal indicia that represents winning or non-winning combinations. The folded sections of the second panel 40 are held together either with glue and/or with perforations 42 extending along and through the side edges of at least the folded sections forming second panel 40. The perforations crimp the folded sections together while allowing the folded sections to be easily separated to view the combination of indicia on the inside thereof. Because the perforations extend through all three of the folded sections, no particular care need be taken in forming the perforations other than forming them along the sides of the a folded sections. The novel surface 44 of the top of second panel 40 (actually the back side of section 52) will have thereon an opaque color such as, for example only, dark blue or black to assist in preventing the concealed indicia from being seen through the folded layers.

Figure 2B:
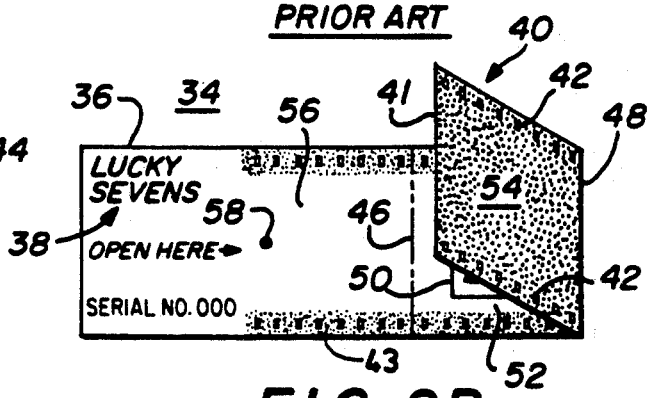
FIG. 2B is a partially opened view of the specialty ticket of FIG. 2A illustrating the opaque surface on the back surface of the outer section and illustrating a glue dot that may be used if desired to provide assistance in preventing unintended separation of the folded sections.
Figure 2C:
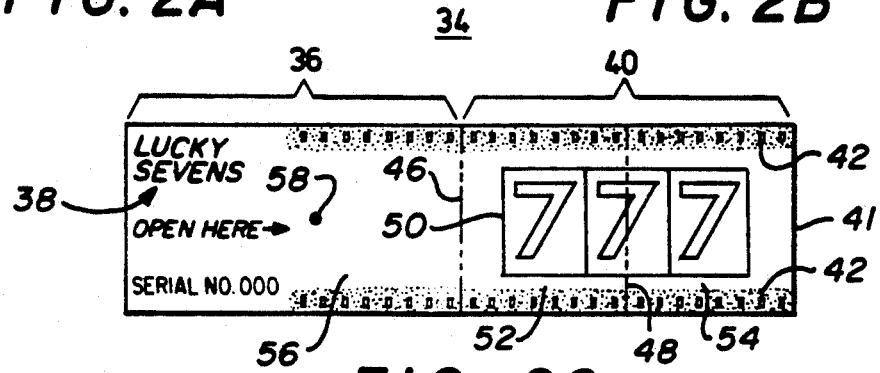
FIG. 2C is a fully opened view of the ticket shown in FIG. 2A and 2B illustrating the hidden indicia on the inner surfaces of the foldable sections.

FIG. 2B is a partially unfolded view of the ticket of 2A. As can be seen in FIG. 2B and FIG. 2C, a first score or fold line 46 separates the first panel 36 from the second panel 40. The terms "score line" and "fold line" are used interchangeably herein. They are terms used to simply indicate the point about which folds are to be made. It is to be understood that no visible fold line need be placed on the ticket at all so long as the ticket is folded at the proper locations. A second score line 48 separates the second panel of the ticket 34 into a first section 52 and a second section 54. The second score line 48 enables the first section 52 and second section 54 to be folded over each other as illustrated in FIG. 2B to form a third section. When section 54 is completely folded about score line 48, the outer end 41 of section 54 lies along score line 46. It is to be noted that the back side of section 54 has the opaque color applied thereon. The first score line 46 enables the third section (folded sections 52 and 54) to be folded over a second adjacent non-indicia bearing area or section 56 of the first panel 36 to form a three thickness portion as shown in FIG. 2A. The perforations 42 extend along and through the side edges of the three thickness portion comprising section 52, section 54 and area 56 of first panel 36 to hold the three thicknesses together while allowing the three thicknesses to be easily separated to view the concealed combination of indicia 50 printed thereon. A glue dot 58 may be placed upon area 56 of panel 36 if required by a governmental agency. If desired, glue dot may be placed on one or more of the sections 52, 54 and 56 in the area where the perforations 42 are shown instead of or in addition to the perforations. Thus, the embodiment illustrated in FIGS. 2A, 2B and 2C is easily formed by cutting the ticket to size, printing the proper indicia thereon, forming score lines, if desired, placing a glue dot 58, if desired, on the area 56 of the first panel 36 and then folding the ticket sections at second score line 48 and first score line 46. The perforations 42 are then formed along and through the side edges of the three thickness portion to hold securely together the three thicknesses formed by sections 52, 54 and 56. Glue dots may be utilized instead of, or in addition to, but in the location of the perforations if desired.

Figure 3A:
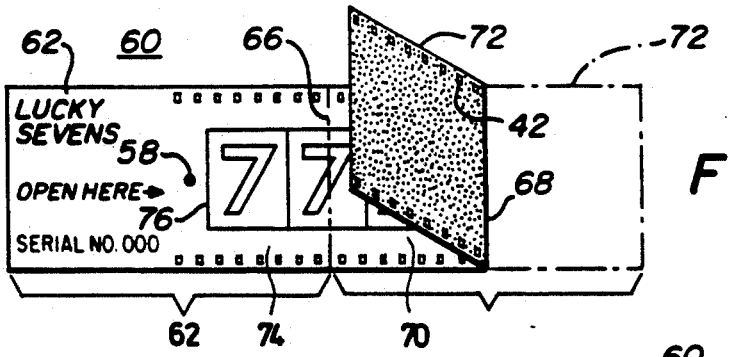
FIG. 3A is a partially unfolded version of a second embodiment of the specialty ticket illustrated in FIG. 2A in which the indicia is shown partially on the inner surfaces of the foldable sections and partially on the first panel with the visible indicia.
Figure 3B:
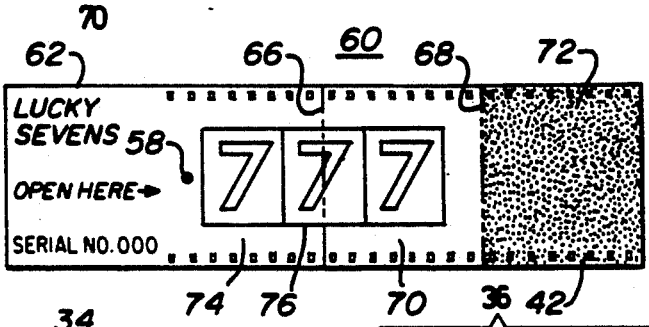
FIG. 3B is a top view of the specialty ticket in FIG. 3A in its fully opened position.

An alternate embodiment of the ticket is illustrated in FIGS. 3A and 3B. When the ticket 60 shown in FIGS. 3A and 3B is folded, it appears as the ticket shown in FIG. 2A. The indicia, however, is located differently on the ticket. As can be seen in FIG. 3A, the ticket is comprised of a first panel 62 and a second panel 64. The second panel is again separated from the first panel by a score line 66. A score line 68 separates the second panel 64 into a first section 70 and a second section 72. Thus, the second score line 68 allows the second section 72 to be folded over the first section 70 to form a third section and then the third section is folded about the first score line 66 over the area or section 74 of the first panel 62 in the same manner as the preferred embodiment in FIG. 2C was folded. However, in FIG. 3A, the indicia 76 has been moved so that it is in the portion 74 of the first panel 62 as well as in the first section 70 of second panel 64.

The fully opened ticket is illustrated in FIG. 3B. One advantage of this embodiment is that the outer second section 72 can be coated with an opaque ink on both sides thus adding to the ability to prevent one from reading the concealed indicia through the outer side of the ticket with a powerful light. Another advantage is that the outer second section 72 can be folded in a clockwise direction about score line 68 to form the embodiment disclosed in FIG. 5 as will be discussed hereafter. Again, a glue dot 58 may be used between the bottom side of the outer second section 72 and the area 74 to assist in preventing a ticket from being inadvertently opened. It should be noted, however, that the perforations 42 will securely maintain the sections in their folded relationship. Because of the regulation of a governmental agency, it may be a requirement that a glue dot be used. However, it is the use of the perforations 42 that primarily keep the folded sections of the ticket in the closed relationship until such time as it is sold to a customer who then opens it. Again, instead of perforations 42, a glue dot may be placed on one or more of the sections 70, 72 and 74 in the area where perforations 42 are shown. When the sections 70, 72 and 74 are folded, they will be securely held to each other by the glue.

Figure 4A:
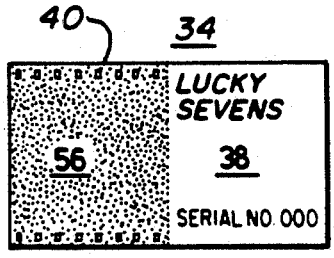
FIG. 4A is a bottom view of the ticket in its folded state as shown in FIG. 2A.
Figure 4B:
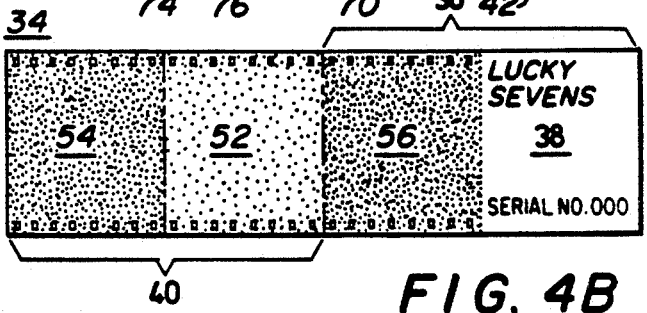
FIG. 4B is a bottom view of FIG. 2C illustrating the ticket in its unfolded state.

FIG. 4A and 4B respectively illustrate the back view of the completed ticket shown in FIG. 2A and the ticket in its opened condition shown in FIG. 2C (and also FIG. 3B except for the numerals). Thus, as shown in FIG. 4A, the back side of the second adjacent area or section 56 illustrated in FIG. 2A is covered with an opaque ink such as the color black for instance. The back side of the indicia bearing portion 38 of the first panel 36 simply repeats information such as the name of the ticket and its serial number.

The back of the fully opened ticket shown in FIG. 4B also has the three sections 54, 52 and 56 illustrated in FIG. 2C covered with an opaque ink such as the colors black or dark blue while again the back of the ticket identifying portion 38 of first panel 36 may repeat information such as the name of the ticket and its serial number. With each of the sections 52, 54 and 56 having one side imprinted with a dark color, there are at least three layers of dark color when the sections are folded. In the embodiment of FIG. 3B there are four layers since second section 72 has both sides imprinted with the dark color.

Figure 5:
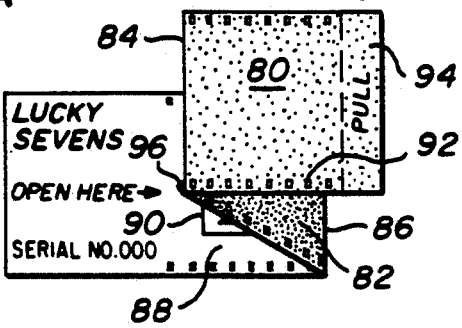
FIG. 5 is an isometric view of an alternate version of the ticket wherein the folded portion of the ticket is folded in a manner different from that illustrated in FIGS. 2B and 3A.

FIG. 5 discloses yet another embodiment of the novel ticket which illustrates a different manner of folding the ticket. In that embodiment, if the hidden indicia 90 is centered on the inside surfaces of sections 82 and 88, then the outer section 80 which may have opaque ink on both sides thereof may be folded about score line 84 over the back side of section 82 and the combine sections 80 and 82 are then folded about score line 86 over section 88. The perforations 92 or glue dots are then applied to at least the side edges of the folded portion of the ticket to hold the folded sections together. The outer section 80 may have an extension or tab 94 thereon which extends beyond the score line 86 when the ticket is folded to provide a pull tab that the user may grasp in order to open the ticket. Again, a glue dot 96 may be placed on section 88, if desired, to assist in preventing the folded sections from being inadvertently separated.

Figure 6:
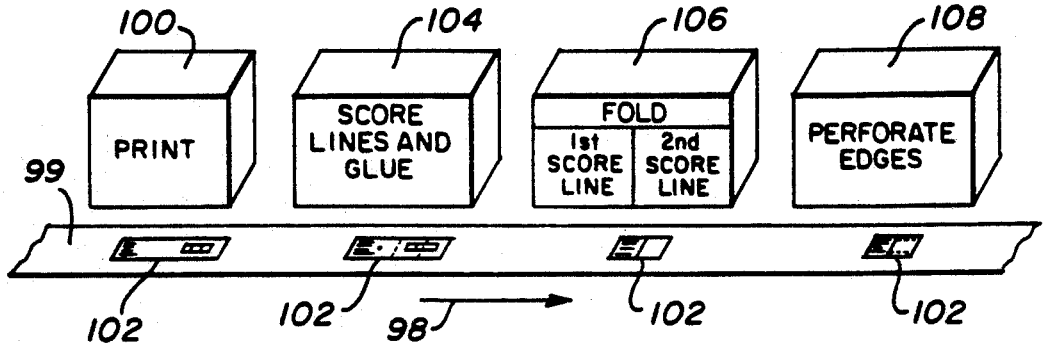
FIG. 6 is a flow diagram illustrating the method and apparatus of the present invention for the printing the indicia and opaque colors on the tickets, providing fold lines, if desired, and placing a glue spot on the ticket or along the edges of the foldable surfaces, folding the ticket and perforating the side edges of at least the folded portion thereof.

FIG. 6 is a flow diagram representing the process by which the novel ticket is made. The numeral 99 is intended to represent the flow of the process and not necessarily a physical apparatus. As the process moves to the right in the direction of arrow 98, at the first stage 100, a printing device, well known in the art, prints information on ticket 102 including the indicia to be concealed. At that stage indicia on both sides of the ticket 102 may be printed in a first operation and the opaque colored ink may be applied to the proper panels in a second operation. The manner of performing these steps is old and well known in the art. The ticket 102 is then transferred to stage 104 where score lines, if desired, and the glue dot, if desired, are added to the ticket 102. As stated earlier, if it is desired to use glue dots instead of or in addition to the perforations, the glue dots would be added at stage 104. Again, the manner of performing these steps and the apparatus 104 utilized are all well known in the art and need not be described in detail here. The printed and scored ticket 102 is then transferred to location 106 where the ticket is folded along a first one of the score lines and then folded again along a second one of the score lines. Again, the apparatus for performing such steps is also old and well known in the art. If perforations are to be used, the folded ticket is then transferred to station 108 where a perforating machine perforates only the outer edges of the folded sections of the ticket 102. Since the glue dot was applied previously at stage 104 the ticket is held together by both the perforations and by the glue dot although, as stated earlier, the perforations adequately maintain the sections in their folded relationship and the glue dot is added only if required by an entity as added assurance.

There is available an adhesive which allows one document to be removably stuck or attached to another because the glue does not form a permanent bond. Such adhesive is used in the sheets of note pads known as "self removal notes." If desired, such adhesive may be used to removably attach the foldable sections to each other in addition to the perforations or glue dot described above. Thus, in FIG. 6, the adhesive 43 would be applied at stage 104 to the edges where the perforations 42 are shown in FIG. 2A through FIG. 5.

Thus there has been disclosed a novel specialty ticket of the type which has a first panel with visible indicia on a portion thereof to identify the ticket and a second panel formed with folded sections concealing indicia that represents winning or non-winning combinations. The folded sections of the ticket are held in their folded state by the use of perforations extending along and through the side edges of the folded sections to hold the folded sections together while allowing the folded sections to be easily separated to view the combination of indicia concealed by the folded sections of the second panel. Where desired, a glue dot can be utilized between the folded sections and the non-folded portion of the ticket to assist in preventing unintended separation of the three thicknesses that form the folded sections of the ticket. In one alternate embodiment a non-permanent bonding adhesive may be used in addition to the perforations thus holding the folded sections securely together while allowing them to be easily separated for viewing the concealed indicia. In another embodiment, glue dots may be used between sections in place of the perforations.

While the invention has been shown and described with respect to a particular embodiment thereof, this is for the purpose of illustration rather than limitation; and other variations and modifications of this specific embodiment herein shown and described will be apparent to those skilled in the art all within the intended spirit and scope of the invention. Accordingly, the patent is not to be limited in scope and effect to the specific embodiment shown and described nor in any other way that is inconsistent with the extent to which the progress in the art has been advanced by the invention.

What is claimed is:

1. In a specialty ticket of the paper type having a first panel with visible indicia thereon to identify the ticket and a second panel formed with folded sections concealing indicia that represents winning and non-winning combinations, the improvement comprising:

bonding adhesive applied to at least portions extending along the sides of only the foldable sections to hold said foldable sections together while allowing said foldable sections to be easily separated to view the combination of indicia concealed by the folded sections forming the second panel; and perforations extending along and through the side edges of at least the folded sections to assist in holding said folded sections together.

2. An improved specialty ticket comprising:

a first panel with visible ticket identifying indicia on at least a first portion and having a second adjacent area;

a second panel separated from said first panel by a first fold line and having indicia thereon representing winning or non-winning combinations, said second panel including first and second sections separated by a second fold line;

said second section being folded over said first section about said second fold line to form a third section of double thickness concealing at least a portion of the winning or non-winning indicia;

said third section of double thickness being folded over said second area of said first panel about said first fold line to form a three thickness portion concealing only the indicia representing winning or non-winning combinations while displaying the ticket identifying indicia;

perforations extending along and through the side edges of at least the three thickness portion to provide a crimping of the side edges and to cause them to adhere tightly together and thereby prevent the hidden indicia from being visible until the crimped side edges are forceably separated;

a glue dot placed between second area of said first panel and the abutting section of the three thickness portion to assist in preventing unintended separation of the sections forming the three thickness portion from said second area; and adhesive applied to at least portions extending along and between the side edges of only the folded sections forming the three thickness portion to assist in holding the folded sections of the three thickness portion together.

3. An improved specialty ticket comprising:

a first panel with visible ticket identifying indicia on at least a first portion and having a second adjacent area;

a second panel separated from said first panel by a first fold line and having indicia thereon representing winning or non-winning combinations, said second panel including first and second sections separated by a second fold line;

said second section being folded over said first section about said second fold line to form a third section of double thickness concealing at least a portion of the winning or non-winning indicia;

said third section of double thickness being folded over said second area of said first panel about said first fold line to form a three thickness portion concealing only the indicia representing winning or non-winning combinations while displaying the ticket identifying indicia;

perforations extending along and through the side edges of at least the three thickness portion to cause them to adhere generally together and thereby prevent the hidden indicia from being visible until the perforated side edges are forceably separated;

a glue dot placed between said second area of said first panel and the abutting section of the three thickness portion to assist in preventing unintended separation of the sections forming the three thickness portion;

at least one opaque color being present on at least one side of at least one of the folded sections forming the three thickness portion to prevent viewing the concealed indicia through the three thickness portion forming the second panel; and adhesive applied to at least portions extending along and between the side edges of only the folded sections forming the three thickness portion to assist in holding the folded sections of the three thickness portion together.

4. An improved specialty ticket comprising:

a first panel with visible ticket identifying indicia on at least a first portion and having a second adjacent area;

a second panel separated from said first panel by a first fold line and having a second fold line separating the second panel into first and second sections, said first section being integrally formed with and abutting said second area of the first panel along said first score line;

a combination of indicia to be concealed representing winning and non-winning combinations extending across at least one of said second area of said first panel and said first section;

said first and second sections being folded about said first fold line over the first panel;

said second section being folded about said second fold line over said first section to form a three thickness portion;

perforations extending along and through the edges of at least the three thickness portion to hold said three thicknesses together while allowing the three thicknesses to be easily separated to view the concealed combination of indicia; and a tab formed on the outer end of said second section, said tab extending beyond the three thickness portion to provide a pull tab for separating the sections of said three thickness portion to view the concealed indicia.

5. The improved ticket of claim 4 further comprising a glue dot placed between at least the first section and the second adjacent area of the first panel to assist in preventing unintended separation of the three thickness portion of the ticket.

6. The improved ticket of claim 4 wherein said ticket has a rectangular shape.

7. The improved ticket of claim 4 further including an opaque color printed on one side of at least one of the first section and said second area of the first panel and on both sides of said second section to prevent seeing through the folded portion of said ticket.

8. A method of forming a specialty ticket comprising the steps of:

printing ticket identifying indicia on at least a first portion of a first panel leaving a second adjacent area;

printing indicia on a second panel representing winning or non-winning combinations, the second panel being formed with and separated from the first panel by a first fold line;

separating the second panel into first and second sections by a second fold line to enable the second section to be folded over the first section to form a third section of double thickness that conceals the winning or non-winning indicia;

folding the third section of double thickness about the first fold line over at least a portion of said second adjacent area of the first panel to form a three thickness portion concealing only the indicia representing winning or non-winning combinations and displaying the ticket identifying indicia;

extending perforations along and through the side edges of at least the three thickness portion to provide a crimping of the side edges and cause them to adhere tightly together and prevent the hidden indicia from being visible until the crimped side edges are forceably separated;

placing a glue dot between said second area of the first panel and the abutting section of the two thickness portion prior to folding the two thickness portion over said second area of the first panel to assist in preventing unintended separation of the sections forming the three thickness portion; and printing at least one opaque color on at least one side of at least one of the thickness prior to folding them to form the three thickness portion to prevent viewing the concealed indicia through the three thickness portion forming the second panel when the sections are folded.

9. A method as in claim 8 further comprising the step of applying adhesive to at least portions extending along and between the side edges of only the folded sections before folding the sections to form the three thickness portion to assist in holding the folded sections of the three thickness portion together.

10. An improved specialty ticket comprising:

a first panel with visible ticket identifying indicia on at least a first portion and having a second adjacent area;

a second panel separated from the first panel by a first fold line and having indicia thereon representing winning or non-winning combinations, said second panel including first and second sections separated by a second fold line;

the second section being folded over the first section about said second fold line to form a third section of double thickness concealing the winning or non-winning indicia;

the third section of double thickness being folded over said second area of said first panel about said first fold line to form a three thickness portion concealing only the indicia representing winning or non-winning combinations and displaying the ticket identifying indicia; and adhesive applied to at least portions extending along and between the side edges of only the folded sections forming the three thickness portion to assist in holding the folded sections of the three thickness portion together.

11. An improved specialty ticket as in claim 10 further including at least one opaque color printed on at least one side of at least one of the folded sections forming the three thickness portion to prevent viewing the concealed indicia through the three thickness portion forming the second panel.

12. An improved specialty ticket as in claim 11 further including perforations extending along and through the side edges of at least the three thickness portion to cause them to adhere generally together and prevent the hidden indicia from being visible until the perforated side edges are forceably separated.

13. An improved specialty ticket as in claim 10 or 11 further including a glue doe placed between said second area of the first panel and the abutting section of the three thickness portion to assist in preventing unintended separation of the sections forming the three thickness portion.

14. In a specialty ticket of the paper type having a first panel with visible indicia thereon to identify the ticket and a second panel having folded sections concealing indicia that represent winning and non-winning combinations, the improvement comprising:

glue placed along at least portions of the side edges of only the sections to be folded to hold the sections together when folded;

crimping perforations extending along and through the side edges of at least the folded sections to assist in holding the folded sections together; and opaque ink placed on at least one side of at least one of the sections to prevent viewing the concealed indicia through the ticket in its folded condition.

* * * * *

UNITED STATES PATENT AND TRADEMARK OFFICE

CERTIFICATE OF CORRECTION

PATENT NO. : 5,253,899
DATED : October 19, 1993
INVENTOR(S) : W. Loren Greenwood It is certified that error appears in the above-indentified patent and that said Letters Patent is hereby corrected as shown below:

Column 2, line 49, delete "CA".
Column 2, line 61, delete "CA".
Column 3, line 9, delete ",,", insert --, --.
Column 3, line 11, change "second" to --section--.
Column 5, line 36, change "desired, glue" to --desired a glue--.
Column 11, line 15, change "doe" to --dot--.
Drawings: Fig. 3A, add No. 64--.

Signed and Sealed this

First Day of August, 1995

Bruce Lehman

*Attest:*

BRUCE LEHMAN

*Attesting Officer*

*Commissioner of Patents and Trademarks*